US007066793B1

(12) United States Patent
Verzi

(10) Patent No.: US 7,066,793 B1
(45) **Date of Patent: *Jun. 27, 2006**

(54) MECHANICAL NON-SERRATED KNIFE GRINDER AND HONER

(76) Inventor: Salvatore Verzi, P.O. Box 4756, Florence, SC (US) 29502-4756

( * ) Notice: This patent issued on a continued prosecution application filed under 37 CFR 1.53(d), and is subject to the twenty year patent term provisions of 35 U.S.C. 154 (a)(2).

Subject to any disclaimer, the term of this patent is extended or adjusted under 35 U.S.C. 154(b) by 86 days.

(21) Appl. No.: 10/930,077

(22) Filed: Aug. 31, 2004

(51) Int. Cl.
*B24B 1/00* (2006.01)
*B24B 3/50* (2006.01)

(52) U.S. Cl. ..... 451/45; 451/312; 76/82

(58) Field of Classification Search ..... 76/82, 76/82.2, 83, 89.1, 89.2; 451/45, 231, 234, 451/278, 312, 321, 322, 361, 372, 387, 403, 451/404, 405

See application file for complete search history.

(56) References Cited

U.S. PATENT DOCUMENTS

| | | | | |
|---|---|---|---|---|
| 1,500,241 | A * | 7/1924 | Gum | 451/552 |
| 2,098,530 | A * | 11/1937 | Battocchi | 451/555 |
| 4,229,910 | A * | 10/1980 | McRae | 451/556 |
| 4,441,279 | A * | 4/1984 | Storm et al. | 451/175 |
| 6,168,509 | B1 * | 1/2001 | Presgrove | 451/552 |

* cited by examiner

*Primary Examiner*—Timothy V. Eley

(57) ABSTRACT

A non-serrated knife sharpening device providing a multitude of blade angle choices during the tapering and honing processes. The adjustable angle choices can be regulated fractionally, grossly, and anywhere in between. The knife is ground utilizing a novel concept whereby two aspects of the blade are held against two adjustably parallel surfaces simultaneously to maintain the grinding angle. Because the knife blade is unencumbered during the sharpening process, extremely acute angles can be incorporated into the clearance angle behind the edge. The device is free-standing, portable, sturdily built, accurate, and simple to use.

6 Claims, 11 Drawing Sheets

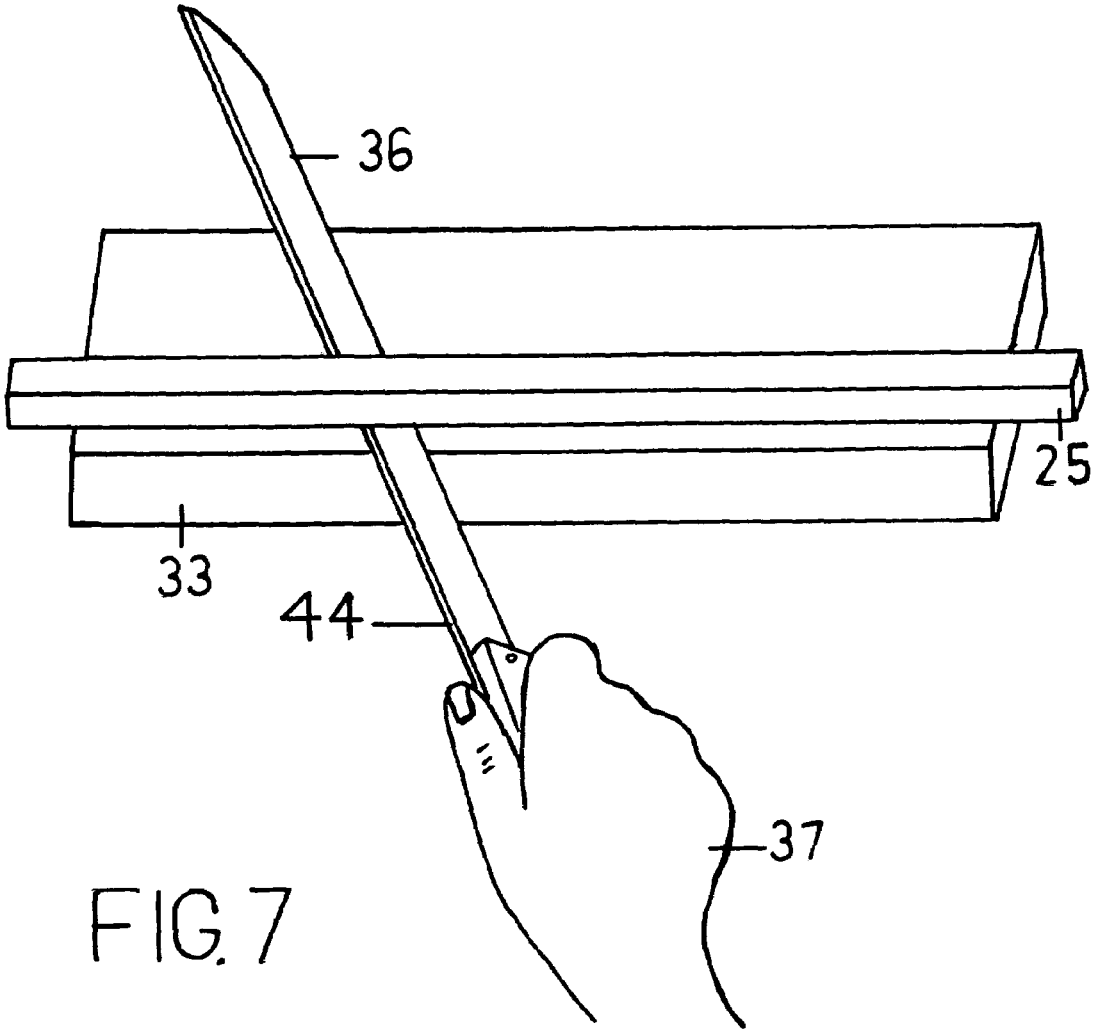
FIG. 7
FIG. 8
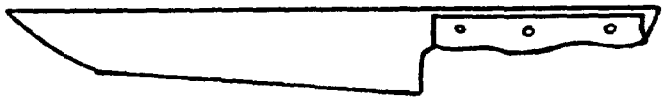
FIG. 9
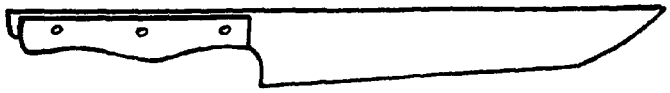

FIG. 10
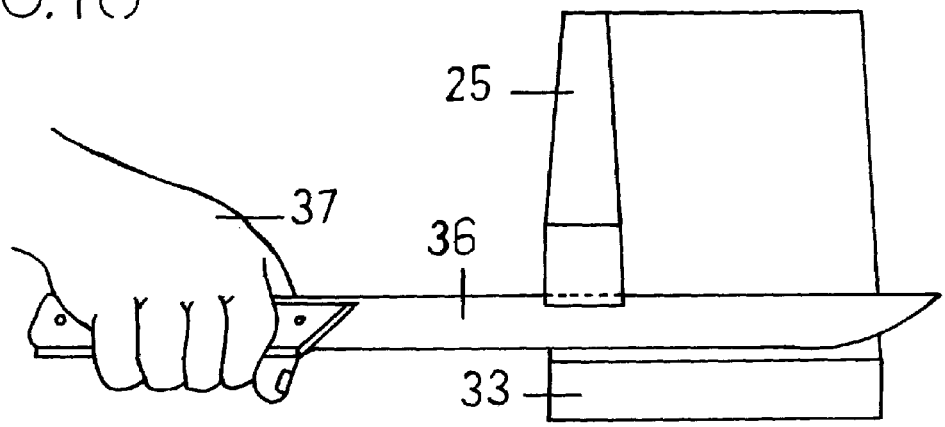
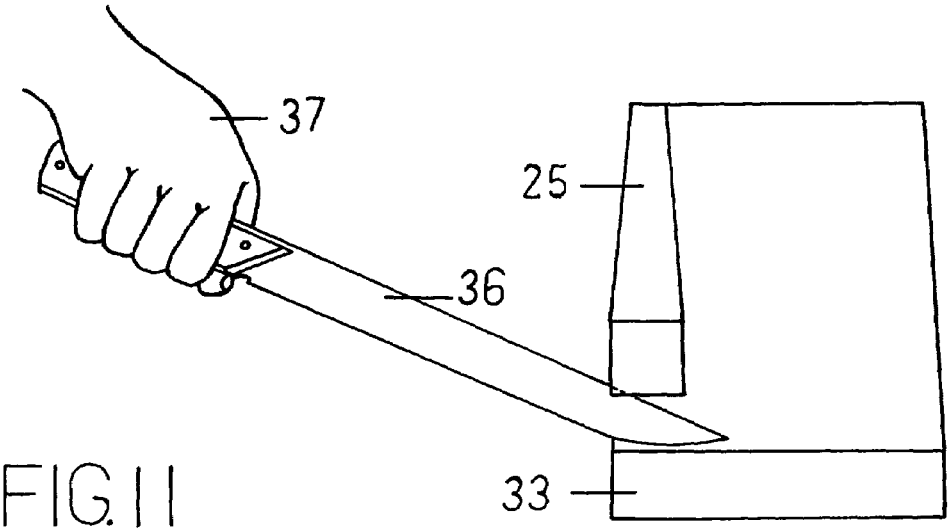
FIG. 11

MECHANICAL NON-SERRATED KNIFE GRINDER AND HONER

CROSS-REFERENCE TO RELATED APPLICATIONS

"Not Applicable"

STATEMENT REGARDING FEDERALLY SPONSORED RESEARCH OR DEVELOPMENT

"Not Applicable"

REFERENCE TO SEQUENCE LISTING, A TABLE, OR A COMPUTER PROGRAM LISTING COMPACT DISC APPENDIX

"Not Applicable"

BACKGROUND OF THE INVENTION

This invention relates to a knife sharpener, specifically to a new and improved non-serrated knife sharpener that is used to properly taper the blade directly behind the edge and also to hone the edge to a razor sharp condition.

Originally knife sharpening was done free-hand and would always result in an edge and edge bevel that was convex in profile. This human frailty is inevitable with every attempt no matter how experienced the person. A convex edge and edge bevel is considered inferior to an edge and edge bevel that is flat in profile. The latter can only be attained by using a grinding and honing angle controlled system.

Prior art has solved this inherent problem only minimally resulting in a reversion to the free-hand method to an extent.

U.S. Pat. No. 3,654,823 to Juranitch (1972) and U.S. Pat. No. 4,441,279 to Storm et al. (1984) both utilize clamping devices that attach directly onto the knife blade to hold the blade in a fixed position for sharpening. These clamps can become an obstacle during the tapering back of the knife blade and as a result both sharpening devices do not have the capacity to grind at very acute angles.

In the majority of instances, a proper tapering of a knife blade must be done and is crucial so that optimum performance of the knife is achieved. Both prior art clamping systems previously mentioned would hinder this process and consequently, a free-hand method would again be necessary.

There is no prior art non-electrical knife sharpening device available to the general public that will allow the user to not only hone the knife blade edge to a razor sharp condition, but in addition, allow the operator to adjust and maintain a multitude of blade angle choices during the edge bevel tapering process. In addition, there is no prior art that will allow the blade to be tapered properly with a multitude of controlled angle choices while the blade is unencumbered and free to traverse the abrasive without a clamping device attached to it.

Therefore, the only other alternative was the free-hand method. To this end, it is necessary to list several additional disadvantages of free-hand knife sharpening.

(a) As was painted out previously, free-hand sharpening will always result in an edge and edge bevel that is convex in profile. This convex shape cancels out the entire clearance angle directly behind the edge and consequently, drastically reduces the cutting ability of the knife.

(b) Repeated free-hand sharpening of a knife will quickly reduce the useful life of the tool because most of the metal that is ground away is being removed from the wrong locations, over and over again.

(c) Using improperly sharpened knives can, over time, result in hand, wrist, forearm, and shoulder afflictions.

BRIEF SUMMARY OF THE INVENTION

Accordingly, several objects and advantages of my invention are:

(a) To provide a non-serrated knife sharpening device which can allow the user to maintain a multitude of blade angle choices during the edge bevel tapering process. These angle choices can range from fractional to gross adjustments and anywhere in between, giving the operator pinpoint control of negative or positive feeds.

(b) To provide a non-serrated knife sharpening device that will not only allow the user to maintain a multitude of blade angle choices during the edge bevel tapering process, but will also give the operator the same flexibility during the honing process to impart a razor sharp edge.

(c) To provide a non-serrated knife sharpening device that will allow the blade to be tapered and honed with a multitude of controlled angle choices without a clamp attached to it. The blade would be unencumbered and free to traverse the abrasive even at extremely acute grinding angles if necessary. Unlike the prior art that utilize a clamping device during the sharpening process, my invention will not force the user to revert back to a free-hand method to taper back the edge bevel.

(d) To provide a non-serrated knife sharpening device that will impart an edge and edge bevel that is flat in profile. This flat profile is considered far superior to an edge and edge bevel that is convex in profile and which will always result with the free-hand method of knife sharpening.

(e) To provide a non-serrated knife sharpening device that can bring out the maximum potential cutting ability of the tool by giving the user a means toward that end.

(f) To provide a non-serrated knife sharpening device that can increase the useful life of the tool by allowing the user to grind away the least amount of metal from the correct locations and impart a razor sharp edge with a proper clearance angle.

(g) To provide a non-serrated knife sharpening device that can reduce the likelihood of hand, wrist, forearm, and shoulder afflictions by drastically reducing the amount of brute strength that would normally be needed to penetrate and cut various materials with an improperly sharpened knife. This benefit could translate into money saved by the potentially afflicted person, his or her employer if applicable, and insurance companies.

Further objects and advantages will be readily seen from taking into account the description, drawings, and operation of my invention.

BRIEF DESCRIPTION OF THE SEVERAL VIEWS OF THE DRAWING

FIG. 7 is a front, fragmentary, perspective view of the guide bar, the tool grinding stone, and the left side of a knife being coarse ground.

FIG. 8 is a left side view of a knife.

FIG. 9 is a right side view of a knife.

FIG. 10 is a right side perspective, fragmentary view of the guide bar, the tool grinding stone, and the left side of a knife being coarse ground.

FIG. 11 is a right side perspective, fragmentary view showing the guide bar, the tool grinding stone, and the tip of the left side of a knife being coarse ground.

DETAILED DESCRIPTION OF THE INVENTION

Figure 1:
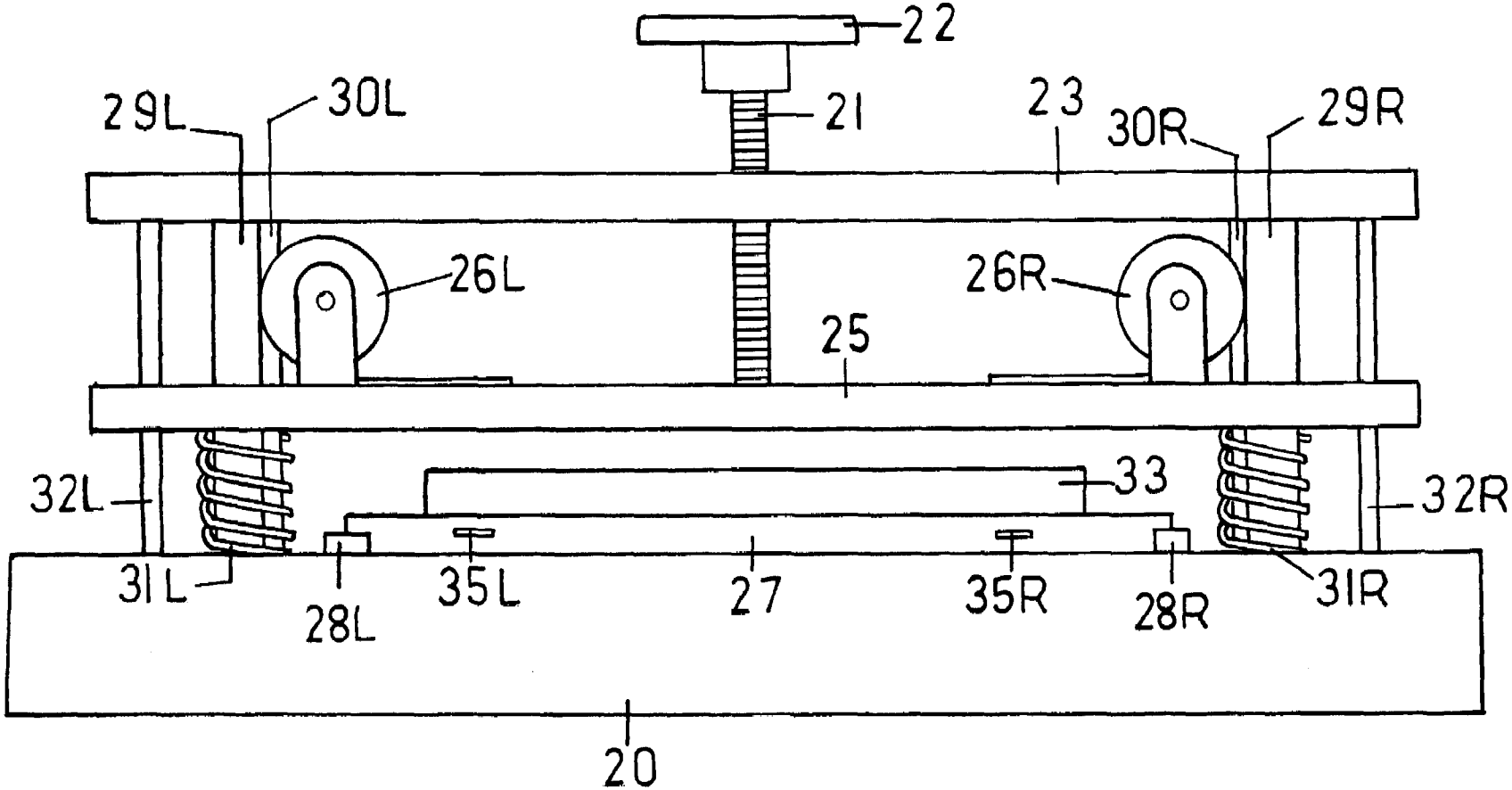
FIG. 1 is a front side orthogonal view of the mechanical non-serrated knife grinder and honer.
Figure 2:
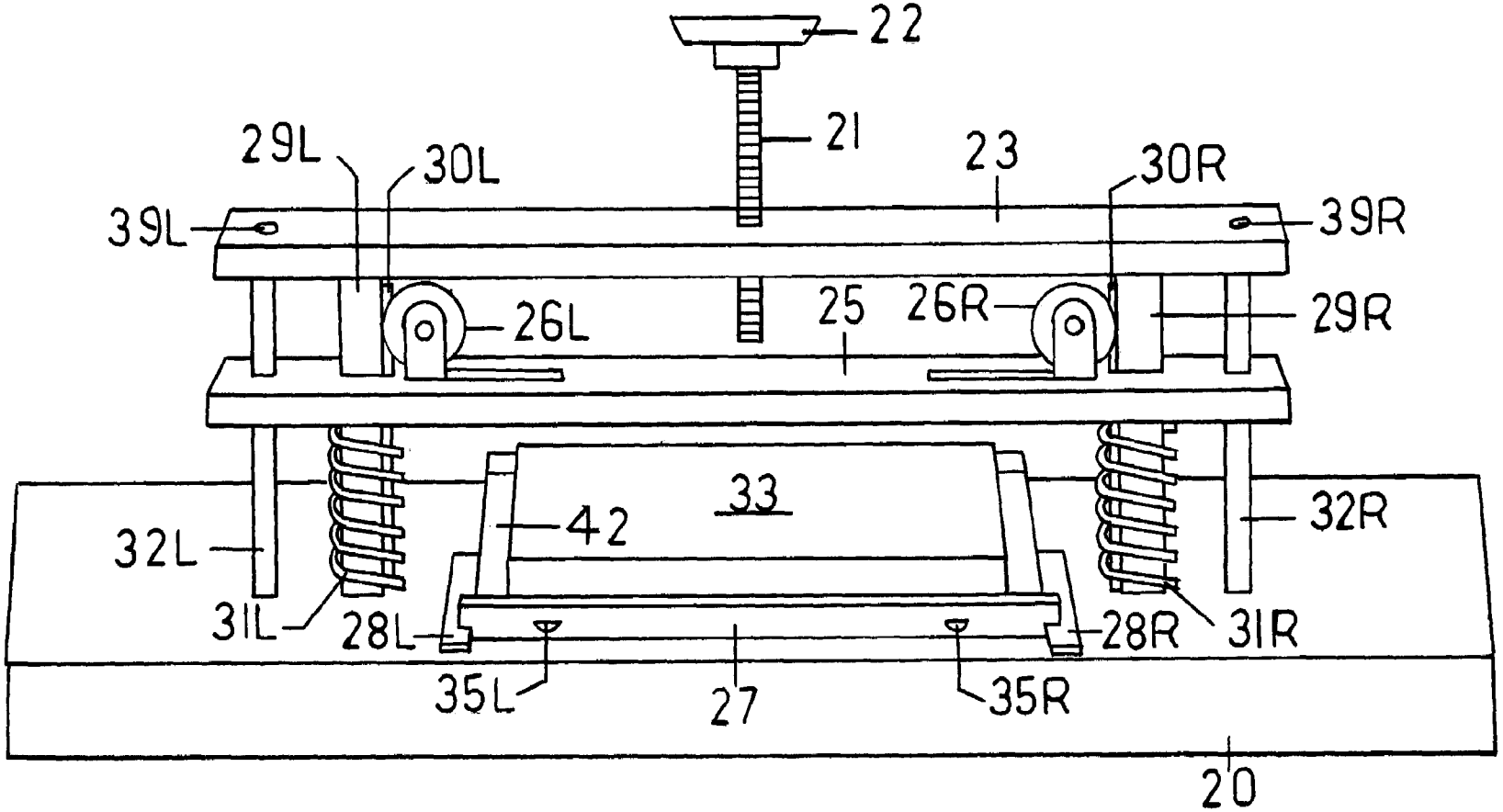
FIG. 2 is a front perspective view of the mechanical non-serrated knife grinder and honer.

This section will reference FIGS. 1–6 and 17. Referring first to the embodiment of FIGS. 1 and 2 is a solid metal mechanical non-serrated knife grinder and honer. A base 20 provides a foundation of substantial enough weight to render the entire device, free-standing, during operation under normal conditions.

Figure 6:
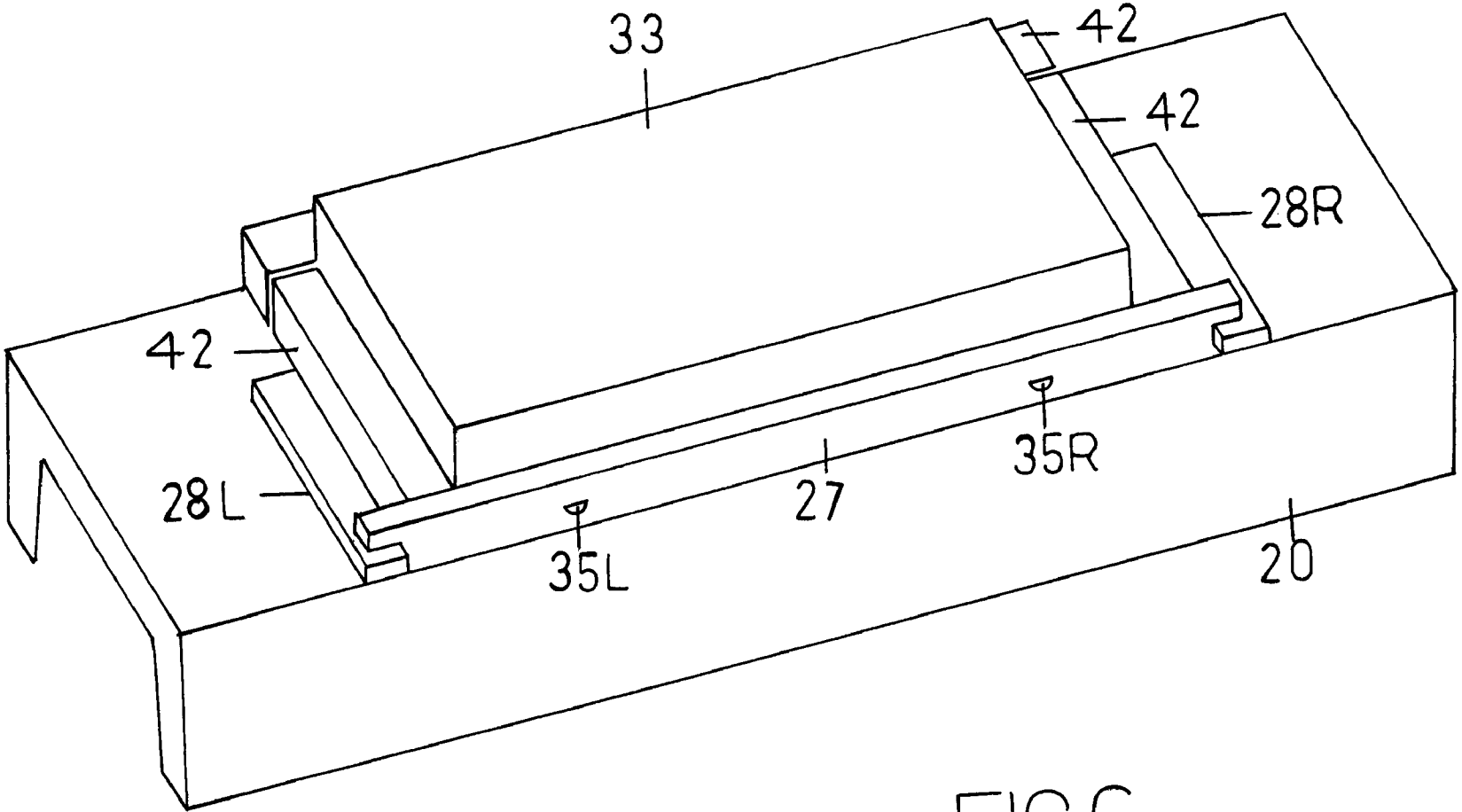
FIG. 6 is a front perspective view of the tool grinding stone, the abrasive housing, and the base.

A non-removable abrasive housing 42 forms a partial surround consisting of three sides only. A removable housing 27 forms the remaining side and is temporarily retained in place by inserting each end into a right and left front housing slot 28R and 28L. A left and right front housing knob 35L and 35R facilitate the dislocation of removable housing 27. Refer to FIG. 6 for best depiction of complete abrasive housing.

The entire abrasive housing as explained in the previous paragraph will retain a tool grinding stone 33 possessing the same outside measurements as the interior measurements of the well formed by the entire surround. In FIG. 6, take notice that tool grinding stone 33, while lying in position within the surround, is approximately twice the height of the abrasive housing elements.

Tool grinding stone 33 is of the large, long lasting variety, standard hardware, and obtainable in a combination form of coarse grit to one side and fine grit on the other. Also available as standard hardware are abrasive stones with the same measurements, obtainable in one grit either coarse or fine.

A right outside track 32R and a left outside track 32L in FIGS. 1 and 2 are positioned vertically near each end of base 20 and are located off center in relationship to the breadth of base 20. Close scrutiny of these elements as seen in FIG. 2 will clearly show their location being closer to the front side of base 20 edge. The reason for this will be emphasized in the ensuing writing. Both elements account for the first one third of a triple symmetrical tracking system with a common goal which will be explained in the operation of the invention.

Figures 5A, 5B, 5C, 5D:
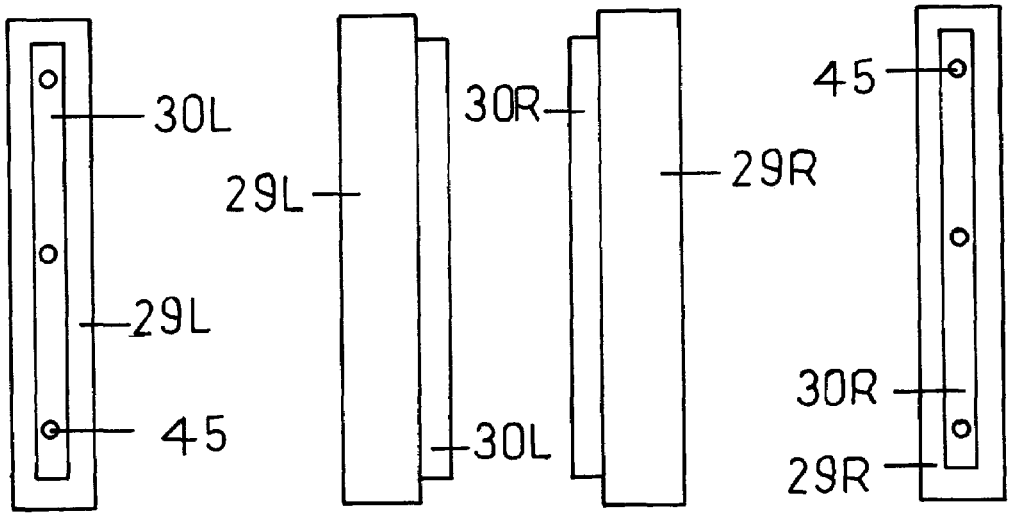
FIG. 5A is a right side view of the left main upright and left wheel track riveted to each other.
FIG. 5B is a front side view of the left main upright and left wheel track.
FIG. 5C is a front side view of the right main upright and the right wheel track.
FIG. 5D is a left side view of the right main upright and the right wheel track riveted to each other.

In FIGS. 5A and 5B a left main upright 29L and a left wheel track 30L are permanently affixed to each other with rivets 45 and the abutted positioning of both elements to each other are clearly self explained. In FIGS. 5C and 5D a right main upright 29R and a right wheel track 30R are permanently affixed to each other with rivets 45 and the abutted positioning of both elements to each other are clearly self explained. The left and right aforementioned elements now affixed and complete can now be appreciated in FIGS. 1 and 2 in their true positions, that is, medially adjacent to and in align with left and right outside tracks 32L and 32R. These elements also constitute the second one third of a triple symmetrical tracking system with a common goal which will be explained in the operation of the invention.

A right compression spring 31R fits uniformly over right main upright 29R and right wheel track 30R and is positioned at the bottom of these elements while at the same time resting upon the upper surface of base 20. A left compression spring 31L fits uniformly over left main upright 29L and left wheel track 30L and is positioned at the bottom of these elements while at the same time resting upon the upper surface of base 20.

Figure 3:
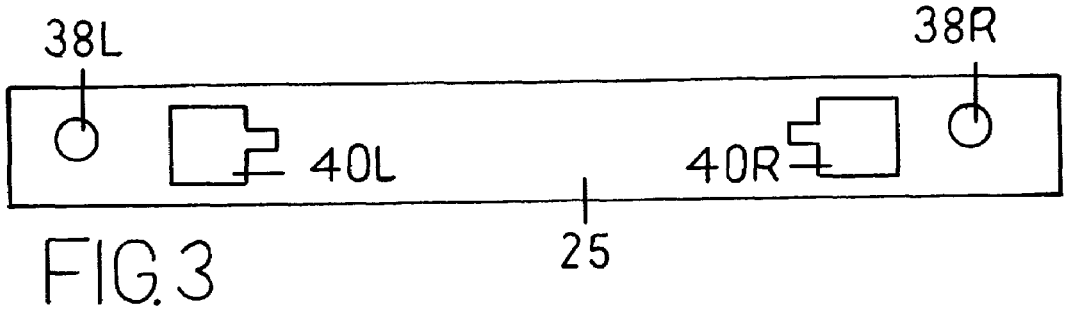
FIG. 3 is a top side view of the guide bar showing the various cut out areas that articulate with like profiles of other parts.

A guide bar 25 FIGS. 1–3 has through and through bored holes fashioned to coincide with like distal profiles of other elements. Referring to FIG. 3, the formed bored profiles are numbered and named as follows: (a) A formed hole for right outside track 38R. (b) A formed hole for left outside track 38L. (c) A formed hole for right main upright and right wheel track 40R and (d) a formed hole for left main upright and left wheel track 40L.

Guide bar 25 is installed into position merely by lining up the aforementioned formed holes over the distal end profiles of the elements as named in the previous paragraph and sliding guide bar 25 downward until seated atop of right and left compression springs 31R and 31L.

Figure 17:
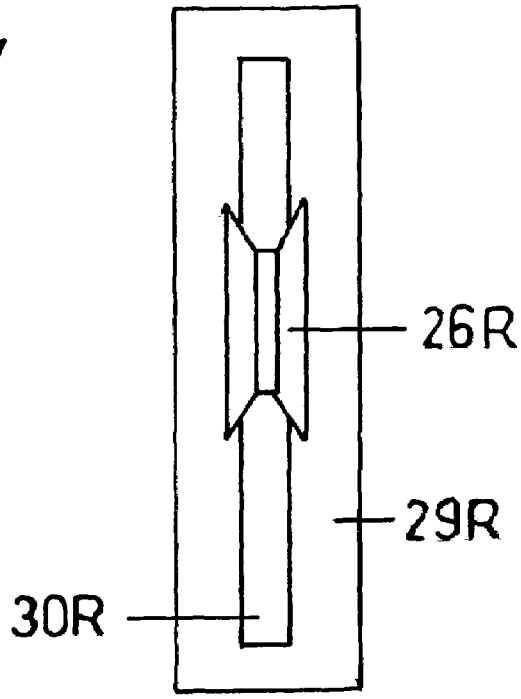
FIG. 17 is a left side view of the right main upright, right wheel track, and the right grooved wheel. Drawing depicts how the wheel articulates with the track.

A right grooved wheel, yoke, and mounting plate 26R of FIGS. 1 and 2, a single unit element obtainable as standard hardware, is positioned onto the upper surface of guide bar 25 in such a way that the groove in the wheel articulates with the surface of right wheel track 30R. FIG. 17 illustrates this articulation clearly. A left grooved wheel, yoke, and mounting plate 26L, an exact replica of 26R, is positioned onto the upper surface of guide bar 25 in such a way that the groove in the wheel articulates with the surface of left wheel track 30L. These grooved wheel elements now in their working positions as in FIGS. 1 and 2 account for the final one third of a triple symmetrical tracking system with a common goal to which will be explained in the operation of the invention.

Figure 4:
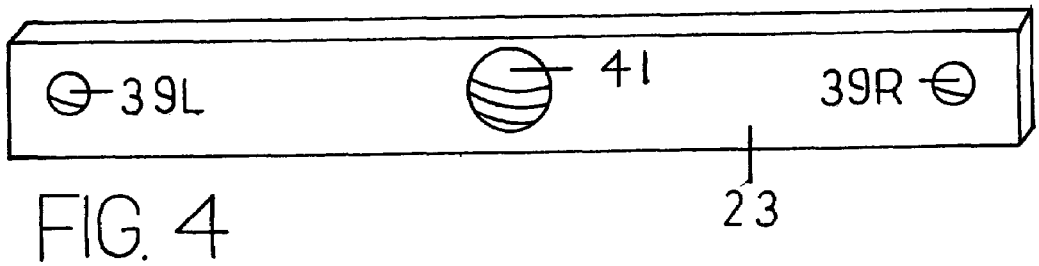
FIG. 4 is a top side perspective view of the stationary horizontal bar showing the cut out areas that articulate with like profiles of other parts and the threaded hole to accommodate the turnscrew.

In FIG. 4, a stationary horizontal bar 23 has formed through and through bored holes which are numbered and named as follows: (a) Hole for left outside track 39L. (b) Hole for right outside track 39R and (c) threaded hole for turnscrew 41. The stationary horizontal bar 23 is installed into a fixed immovable position as depicted in FIGS. 1 and 2.

Lastly, a turnscrew 21 is threaded into the threaded hole for turnscrew 21 with clockwise rotations of a turnscrew knob 22 until the proximal end of turnscrew 21 meets the upper surface of guide bar 25. This is the neutral position and should be maintained while the device is in storage so that the tension on compression springs 31R and 31L is zero.

The manner of using the mechanical non-serrated knife grinder and honer can best be understood more clearly by a thorough indoctrination first, of the function and operation of the individual parts comprising the invention.

Referring to FIGS. 1–3. Base 20 is a strong foundation for the attachment of all elements of the upper framework. Under normal conditions it is not necessary to secure base 20 to a work table during use, it being of adequate weight, breadth, and and balanced.

During the knife sharpening operation and immediately following the coarse grinding, an abrasive stone changeover must take place to hone the edge. The entire abrasive housing apparatus allows for a quick change of tool grinding stone 33 without having to bring all moving parts of the device back to neutral position. The removable housing 27 is lifted off with left and right front housing knobs 35L and 35R, tool grinding stone 33 slid out of the now opened front side, the next tool grinding stone 33 is slid into the well formed by non-removable abrasive housing 42, and removable housing 27 replaced into front housing slots 28R and 28L.

At this point in the discussion it must be emphasized that the first phase in understanding the operation of the invention is complete. To briefly summarize, tool grinding stone 33 is now form fitted into a secure housing, a means of removing and replacing tool grinding stone 33 without disturbing other elements of the device is in place, and lastly, the upper surface of tool grinding stone 33 is in a flat, level, knife grinding and honing position.

The next objective is to provide a means of lowering and raising the entire guide bar 25 above the upper surface of tool grinding stone 33 to a myriad of various adjustable heights. In addition, to maintain a parallel integrity between the upper surface of tool grinding stone 33 and the under surface of the guide bar 25 at all times.

To accomplish this, all elements in the superstructure must work in synchronization. By rotating turnscrew knob 22 clockwise, the right hand threads on the surface of turnscrew 21 engage and mesh with like threads on the surface of threaded hole for turnscrew 21 causing the shaft of turnscrew 21 to move downward and eventually make contact with the upper surface of guide bar 25.

Guide bar 25, until this contact occurred, was in a neutral position and lying in suspension atop of relaxed right and left compression spring 31R and 31L.

Immediately upon contact of the proximal surface of turnscrew 21 with the upper surface of guide bar 25, the following events occur: (a) Guide bar 25 moves downward. (b) Compression springs 31R and 31L counter resist the downward force and their coils begin to slowly compact, yet, at the same time allowing guide bar 25 to continue its downward path in a slow, methodical, orderly manner. (c) Laxity in turnscrew knob 22 when rotated is now essentially nil, due to the force and counter-force arrangement, making it possible for even micrometer like adjustments in either direction. (d) Simultaneously, when guide bar 25 moves, six sets of articular surfaces are meshing with each other, namely, right and left outside track 32R and 32L profiles with right and left formed holes for right and left outside tracks 38R and 38L, the profiles of right and left main uprights 29R and 29L and right and left wheel tracks 30R and 30L with right and left formed holes for right and left main uprights and right and left wheel tracks 40R and 40L, and finally the articulation of right and left wheel tracks 30R and 30L with right and left grooved wheel units of 26R and 26L.

The aforementioned six sets of articular surfaces that mesh with each other during operation of the device constitute the triple symmetrical tracking system highlighted previously. The common goal of this tracking system is to ensure that with every movement of guide bar 25, whether it be up or down, a fractional or gross adjustment, no matter how high or low the space formed between them, that the undersurface of guide bar 25 and the upper surface of tool grinding stone 33 will always be parallel.

Conversely, when turnscrew knob 22 is rotated counter-clockwise, guide bar 25 begins moving upwards as a result of a lessened downward force and a steady recoiling of compression springs 31R and 31L. When compression springs 31R and 31L recoil to a perfectly relaxed position the device as a whole is said to have returned to neutral.

Now that there is a thorough understanding of how all of the parts of the device work and their individual objectives have been explained, the actual step by step process of grinding and honing a non-serrated knife blade will now commence.

In reference to FIGS. 1,2,7–16, and 18. FIGS. 7,10–16, and 18 are all fragmentary drawings showing only the necessary elements involved in the actual sharpening of a knife. This was done intentionally to clarify each demonstration.

Referring first to FIGS. 8 and 9. In both Figures a typical household knife is shown. For the purpose of this discussion FIG. 8 will represent the left side of the knife and FIG. 9 the right side. In FIG. 7 a knife blade spine 44 will play an essential role in sharpening a knife on this invention.

Step one is to install coarse tool grinding stone 33 into the abrasive well formed by non-removable abrasive housing 42 and removable housing 27. Next, measure the width of knife blade 36 near the middle of the blade itself. Again, for the sake of this discussion, one inch will be the width measurement. Divide width measurement by two. One half inch will be the first setting on the device. Note: The inventor has deduced this formula mathematically during invention testing.

Figure 18:
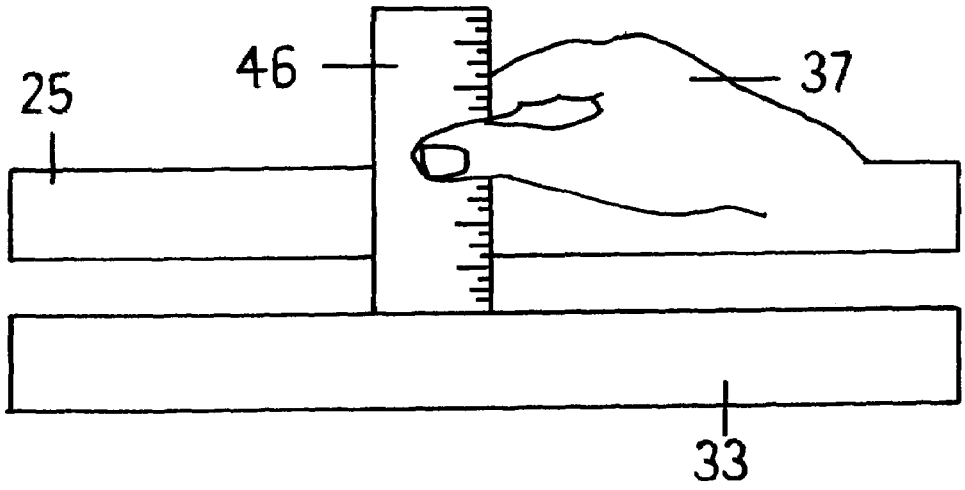
FIG. 18 is a front side fragmentary view of the guide bar and the tool grinding stone. Drawing depicts how the space is measured before knife grinding.

To set the device for one half inch, lower guide bar 25 and at the same time, measure the height of the space between the upper surface of tool grinding stone 33 and the undersurface of guide bar 25 with a small ruler 46 until this setting is reached as depicted in FIG. 18.

The next step involves taking the knife handle into right hand 37 (if right handed) and cause knife blade 36 to enter the one half inch space horizontally, right side up, FIG. 9, tip first. Once inside the space, right hand 37 rotated clockwise until two events take place: (a) Knife blade spine 44 contacts the undersurface of guide bar 25 and (b) the left side of the knife, FIG. 8, blade edge contacts the upper surface of tool grinding stone 33. FIG. 7 is a frontal view of the grinding position of right hand 37 and knife blade 36. FIG. 10 is a right end view of a similar rendition.

The entire length of the straight part of knife blade 36, left side, can now be coarse ground across width of tool grinding stone 33 with knife blade 36 pointed slightly askew as in FIG. 7. Use moderately long push and pull strokes to grind the entire straight part of knife blade 36. If knife blade 36 is very long, grind it in overlapping segments. The entire surface of tool grinding stone 33 should be utilized so that even wear will ensue. The user will ensure at all times during actual grinding, that knife blade spine 44 is held against the undersurface of guide bar 25. This sustained positioning will impart a consistently ground bevel which is flat in profile.

To negotiate and coarse grind the tip of the left side of knife blade 36, the handle of the knife is raised diligently in conjunction with the curvature of the arc as in FIG. 11. It will also be noted in FIG. 11 that knife blade spine 44 of knife blade 36 is still in contact with a portion of the undersurface of guide bar 25. Use much shorter grinding strokes when negotiating the tip. Also worth mentioning at this time is the fact that guide bar 25 was purposely located very near to the front of the device to more easily grind the tips of the knives.

When a burr or roughened edge is formed on the entire opposite side (the right side FIG. 9) of knife blade 36, grinding must stop.

Figure 12:
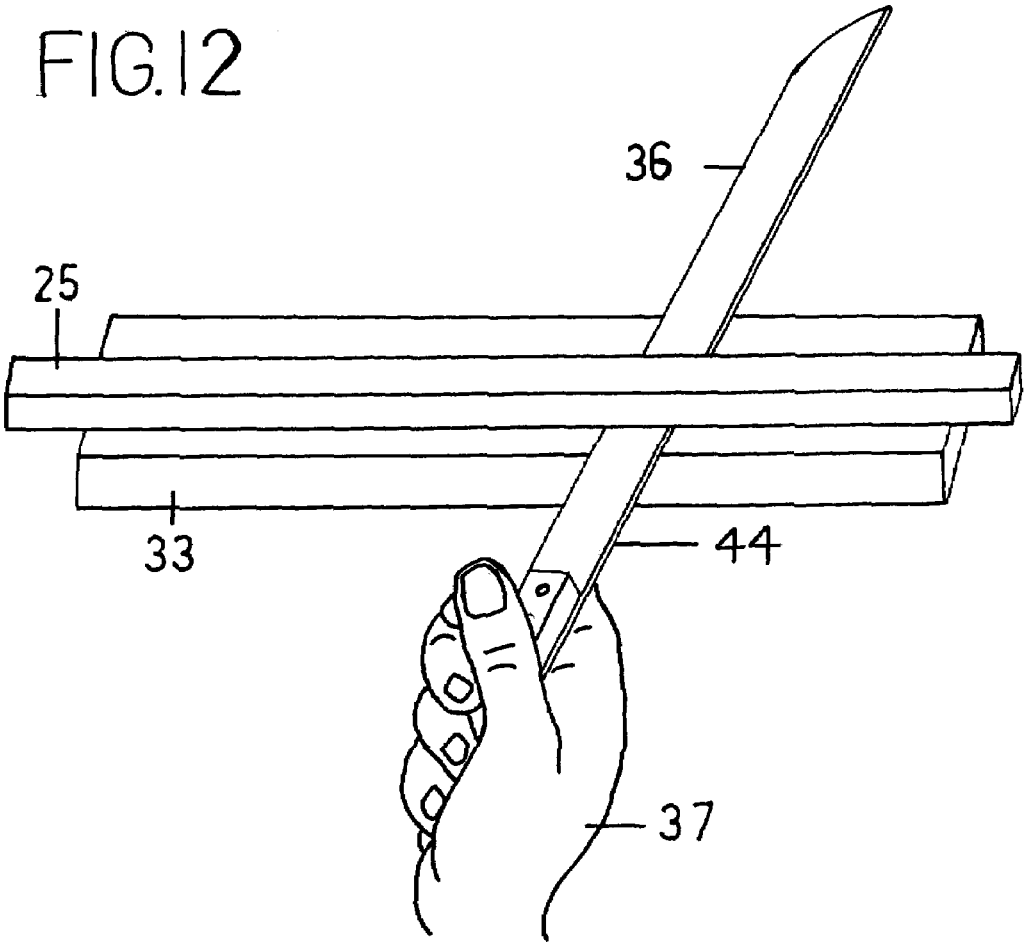
FIG. 12 is a front, fragmentary, perspective view of the guide bar, the tool grinding stone, and the right side of a knife being coarse ground.
Figure 13:
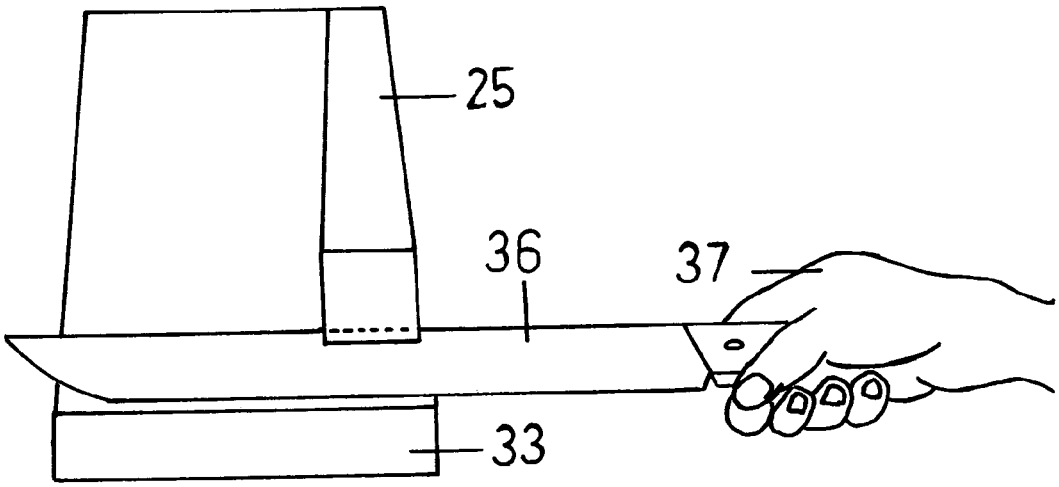
FIG. 13 is a left side perspective, fragmentary view showing the guide bar, the tool grinding stone, and the right side of a knife being coarse ground.
Figure 14:
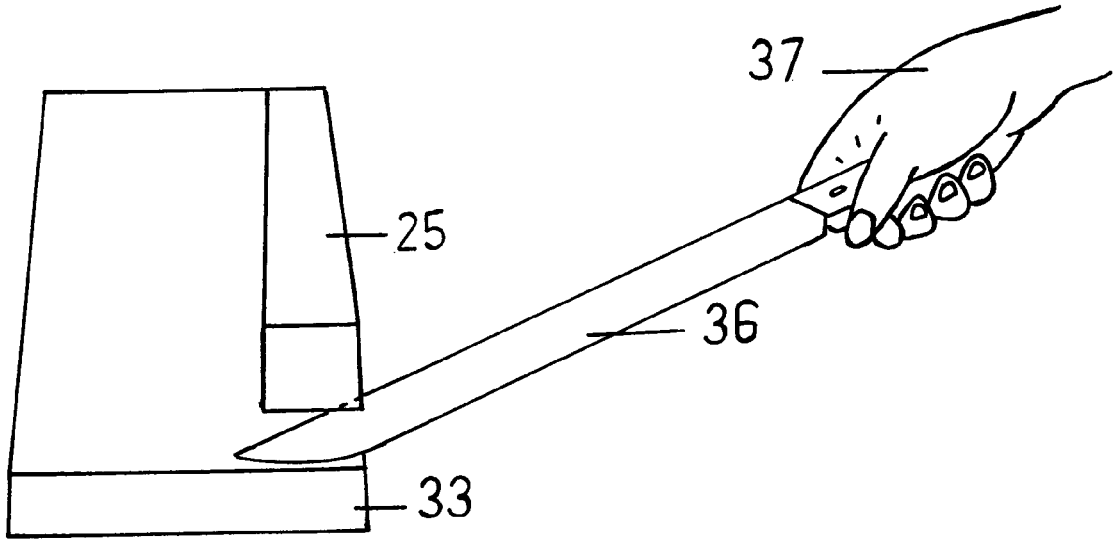
FIG. 14 is a left side perspective, fragmentary view showing the guide bar, the tool grinding stone, and the tip of the right side of a knife being coarse ground.

To grind the other side of the knife, cause knife blade 36 to enter the one half inch space horizontally, left side up FIG. 8, tip first. Once inside the space, right hand 37 is rotated counterclockwise until knife blade spine 44 contacts the undersurface of guide bar 25 and the right side of the knife FIG. 9 blade edge contacts the upper surface of tool grinding stone 33. FIG. 12 is a frontal view of the grinding position of right hand 37 and knife blade 36. FIG. 13 is a left side view of a similar rendition. Coarse grind this side of knife blade 36 edge exactly the same way as was done on the opposite side. See FIGS. 12–14. Stop grinding when a burr is formed on the entire opposite side (the left side FIG. 8) of knife blade 36.

This initial coarse grinding on both sides at this particular angle normally takes less then two minutes. What has been accomplished thus far is the obliteration of the previous edge and the initiation of a new one.

The next step is to taper blade 36 back directly behind the newly ground edge on both sides 60 that a proper clearance angle is formed. To do this, lower guide bar 25 again approximately one eighth inch. Coarse grind knife blade 36 on both sides once again using exactly the same technique that was used for the initial coarse grinding only this time, the grinding will stop when the new grind marks merely reach the edge on both sides. Normally, coarse grinding the taper on both sides takes only about two to three minutes total on this device.

To summarize thus far, the old knife edge was obliterated from both sides, a new edge initiated from both sides, and finally a clearance angle for the new edge was ground on both sides.

The final step will be to hone knife blade 36 edge on both sides to a razor sharp condition. First, remove the coarse tool grinding stone 33 and replace it with a fine grit tool grinding stone 33. Raise guide bar 25 back to the original height of one half inch. A right handed user now stands at the front left corner of the device at about a 45 degree angle to the right.

Figure 15:
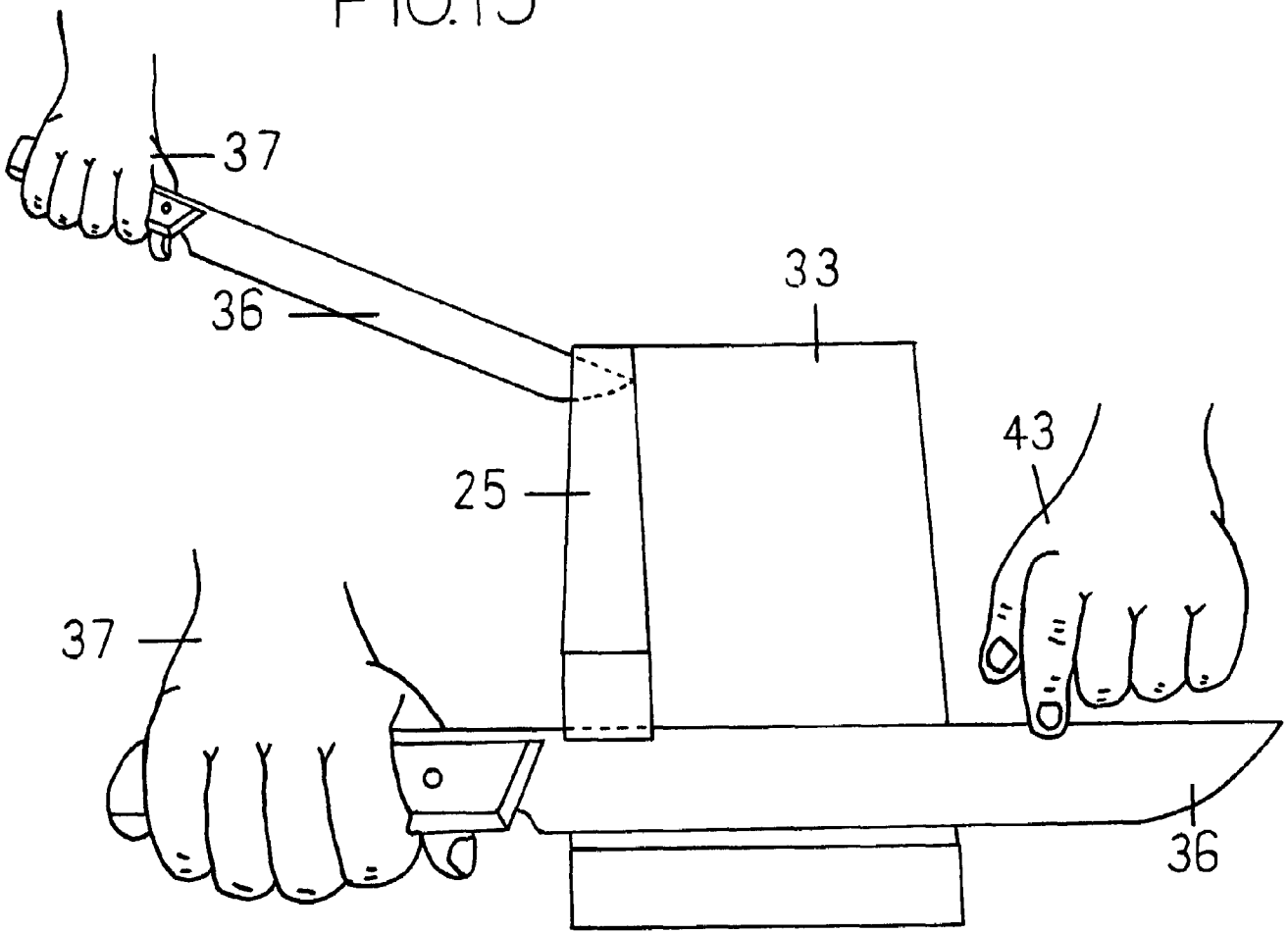
FIG. 15 is a right side perspective, fragmentary view of the guide bar, the tool grinding stone, and the left side of a knife being honed. Drawing depicts a continuous related series of events.

The user will now hone the entire length of the left side of knife blade 36 edge, FIG. 15, in one fluid, non-hesitating motion starting with the handle in a raised position to expose the extreme end of the tip to tool grinding stone 33 while at the same time ensuring that knife blade spine 44 is in constant contact with a portion of the undersurface of guide bar 25.

When the honing has commenced and the curved tip of knife blade 36 has cleared guide bar 25, and knife blade 36 is returning to a level positioning, the index finger of left hand 43 as seen in FIG. 15 should be utilized to give the user additional dexterity throughout the remainder of the maneuver.

Figure 16:
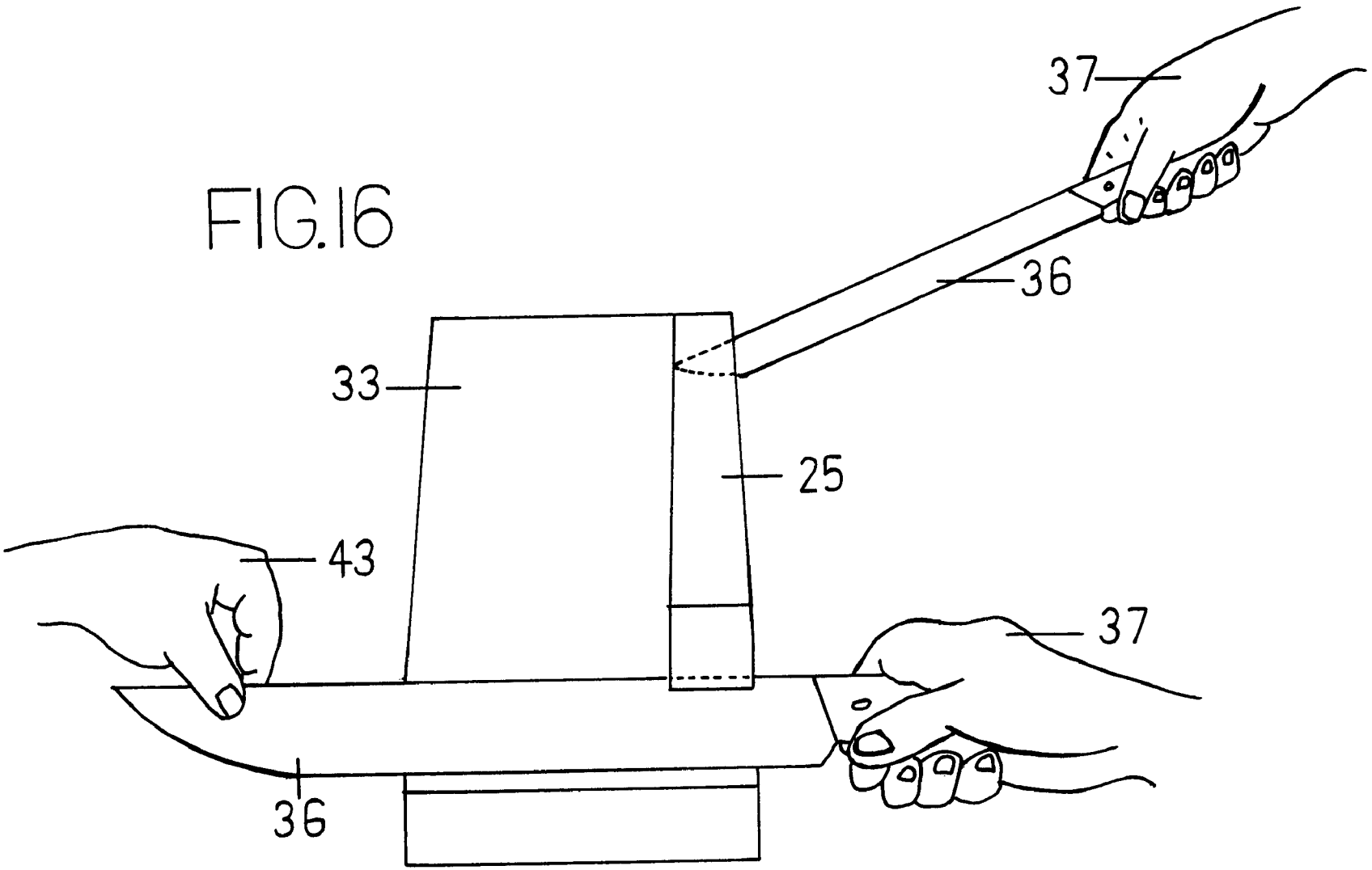
FIG. 16 is a left side perspective, fragmentary view of the guide bar, the tool grinding stone, and the right side of a knife being honed. Drawing depicts a continuous related series of events.

To hone the entire right side of knife blade 36 edge, the user remains in the same position and in accordance with FIG. 16, raises the knife handle to expose the extreme end of the tip to tool grinding stone 33 while at the same time ensuring that knife blade spine 44 is in constant contact with a portion of the undersurface of guide bar 25. Then, with one fluid, non-hesitating motion and with the assist of the thumb and index fingers of left hand 43 when the tip clears guide bar 25, hone the entire right side of knife blade 36 edge.

Hone each side of knife blade 36 edge alternately for approximately one dozen times.

The left handed person uses the device just as easily as a right handed person. For example, the left handed adaptations of FIGS. 7,10, and 11 to coarse grind the left side of knife blade 36 edge would simply involve rotating left hand 43 clockwise instead of right hand 37. Similarly, the left handed adaptations of FIGS. 12,13, and 14 to coarse grind the right side of knife blade 36 edge would involve rotating left hand 43 counterclockwise instead of right hand 37.

In regards to honing knife blade 36, the left handed person would position his or herself at the front right corner of the device at about a 45 degree angle to the left, the exact opposite position of the right handed person and consequently, the remaining maneuvers would follow a similar mirror image of FIGS. 15 and 16.

It should be noted at this time that the setting of guide bar 25 down approximately one eighth inch for coarse grinding the clearance angle for the demonstration should be considered a general purpose angle. Ultimately, it is the option of the operator as to how acute this clearance angle should be and most certainly, there is a myriad of angles to choose from.

Accordingly, one can see that the non-serrated knife grinder and honer invention is a versatile device which allows the user to maintain a multitude of knife blade grinding angle choices during both the tapering back and honing processes. These angle choices can range from fractional to gross adjustments and anywhere in between.

The invention is free-standing during operation under normal circumstances, and in addition, does not utilize clamping devices to hold the knife blade.

The resultant ground bevels are flat in profile and far superior to the rounded profiles that exemplify the free hand method of knife sharpening. This advantage reduces the amount of strength needed to cut various materials and could lessen the likelihood of hand, wrist, forearm, and shoulder afflictions.

Although the description of the invention includes many particulars, they should not be interpreted as boundaries in regards to its scope but more precisely, distinctions of some of the preferred embodiments of this invention. For example a hydraulic or pneumatic system could be used to raise and lower the guide bar; four grooved wheels instead of two could be used for an inside and outside rotary tracking system; a built in clamp could be used to secure the device to a work table for situations such as aboard ship; a round profiled guide bar could be used instead of a square profiled guide bar; a worm gear system to raise and lower the guide bar could be used with a crank operated from one end of the device as opposed to above the unit; a rack and pinion system could be used to raise and lower the guide bar; the device could be made from a mold or casted utilizing extremely light weight materials such as aluminum, plastic, or one of its derivatives; a built in measuring device could be used to not only measure the height from abrasive to guide bar undersurface but also to display an angle value as well; electricity could be used to power all moving parts; a mechanical means could be used to hold the knife blade spine and edge in a wedged position to maintain the grinding angle; a hydraulic or pneumatic system could be employed as a counter-force in conjunction with raising and lowering the guide bar, et cetera.

Therefore, the scope of the invention should be defined by the attached claims and their lawful corresponding functions instead of the examples given.

I claim:

1. A knife blade sharpening device comprising: a base, a rigid framework attached to an upper surface of said base, said framework comprising a receptacle forming a rectangular inner space for retaining a sharpening block, a sharpening block mountable in said receptacle;

a plurality of vertical stanchions located on distal ends of the receptacle, a plurality of resilient members located on said stanchions and resting upon said base, a movable horizontal guide bar located above said receptacle and cooperating with said stanchions and being movable along longitudinal axes thereof by means located on top of the movable horizontal guide bar near distal ends thereof, said means being in contact with said stanchions;

a stationary horizontal bar attached to upper ends of said stanchions and located above and parallel to an upper surface of said guide bar, a device adapted to convert circular motion into reciprocating motion, said device comprising means attached to a turning mechanism and pivotably attached to said stationary bar;

whereby rotation of said turning mechanism in opposite directions causes said means attached thereto to move downwardly and upwardly thereby moving the guide bar in downward and upward directions relative to said receptacle thus causing a space between an undersurface of the guide bar and an upper surface of the sharpening block when said sharpening block is mounted in the receptacle to decrease or increase, the undersurface of the guide bar remaining in a parallel relationship with the upper surface of the sharpening block.

2. The knife blade sharpening device of claim 1, wherein the means located on top of the guide bar are wheels which contact the stanchions for movement therealong.

3. The knife blade sharpening device of claim 1, wherein the resilient means are compression springs located around the stanchions and beneath the guide bar for resisting downward movement of said guide bar caused by said device.

4. The knife blade sharpening device of claim 1, wherein the receptacle is slidably dislocatable to allow for replacement of said sharpening block.

5. The knife blade sharpening device of claim 1, wherein said means attached to said turning mechanism comprises a rigid elongated machine finger for contacting an upper surface of said movable horizontal guide bar.

6. A method of sharpening a knife blade, using the knife blade sharpening device of claim 1, comprising the steps of:

a. measuring the width of said knife blade near its center and dividing said measurement by 2;

b. setting said movable horizontal guide bar to a distance above the upper surface of said sharpening block equal to the quotient obtained from step (a);

c. coarse grinding one side of an edge of the knife blade until the edge is roughened and repeating said coarse grinding on the other side of said edge opposing said one side;

d. moving said guide bar down approximately one eighth inch and repeating the coarse grinding of step © on said edge, and ceasing grinding when grinding marks created by said grinding merges with extreme edge borders on said edge; and e. resetting said guide bar back to the original height above said sharpening block set in step (b)and fine honing said knife blade edge to a razor sharp condition.

* * * * *